United States Patent [19]

Boykins, Jr.

[11] 4,389,733

[45] Jun. 28, 1983

[54] UNIFORM FOR KARATE AND THE LIKE

[76] Inventor: James L. Boykins, Jr., 1615 N. Monroe St., Baltimore, Md. 21217

[21] Appl. No.: 234,929

[22] Filed: Feb. 17, 1981

[51] Int. Cl.[3] ..... A41D 13/00; A41D 27/20

[52] U.S. Cl. ..... 2/2; 2/250; 2/234

[58] Field of Search ..... 2/2, 22, 23, 24, 228, 2/234, 250, 227, 238, 403, 404, 247, 111, 83, 405; 128/159, 160, 161, 557, 558, 526

[56] References Cited

U.S. PATENT DOCUMENTS

| | | | |
|---|---|---|---|
| 2,058,509 | 10/1936 | Rose | 2/238 |
| 3,207,155 | 10/1965 | Casey | 2/405 |
| 3,787,892 | 1/1974 | Quinn | 2/2 |
| 3,788,314 | 1/1974 | Noreen | 128/159 |
| 4,014,044 | 3/1977 | Figueroa | 128/160 |
| 4,035,844 | 7/1977 | Atack | 2/2 |
| 4,128,902 | 12/1978 | Siebert | 2/2 |

FOREIGN PATENT DOCUMENTS

| | | | |
|---|---|---|---|
| 119288 | 7/1900 | Fed. Rep. of Germany | 2/227 |

*Primary Examiner*—Werner H. Schroeder
*Assistant Examiner*—Steven N. Meyers
*Attorney, Agent, or Firm*—John F. McClellan, Sr.

[57] ABSTRACT

A uniform trouser garment for use in martial arts such as Karate has a generally triangular symmetrical front flap with an interior pocket for holding in position a groin protective cup; an apex of the front flap is hinged by a non-metallic attachment at a mid-crotch location, adjacent which a strap additionally secures the groin protector, and covers a similarly-shaped but smaller opening located in the front of the garment below a waistband portion; for quick-detach but multiply secure fastening in the up or wear position the front flap has along the inner periphery upward margins strips of "Velcro" material for interlocking in overlapping relation with matching-location strips of material along the margins of the opening, and has across the top or base of the triangular shape on the inner side of the front flap a transverse strip of "Velcro" material which mates with a similar type strip along the inner face of waistband portion when the front flap, which extends above the waistband portion, is folded rearwardly over the waistband portion; this multiply holds the front flap in wear position by means of the folding, the "Velcro" engagement, and the compression of the fold and "Velcro" engagement by the user's body against the waistband portion.

2 Claims, 5 Drawing Figures

UNIFORM FOR KARATE AND THE LIKE

FIELD OF THE INVENTION

This invention relates generally to apparel and particularly to a uniform for use in the martial arts, such as Karate teaching and study.

BACKGROUND OF THE INVENTION

In the prior art various disclosures of special apparel have been made, including those of the following U.S. Pat. Nos.

3,787,892 issued to P. H. Quinn on 1-29-74, discloses a hockey garment with detachable retaining means for a protective cup;

3,788,314 issued to D. L. Noreen on 1-29-74, discloses a garment for use in playing hockey or the like with an openable pouch-closure for containing a protective cup;

4,014,044 issued to D. C. Figureron and D. R. Corneliuz, discloses a pair of trunks with a protective member extending front and rear, and co-acting pocket retention for same;

4,035,844 issued to J. W. Atack, H. Triano and P. Zoretich on 7-19-77, discloses a trouser-like article with outwardly openable front pocket for containing a protective cup;

4,128,902 issued to G. R. Siebert on 12-12-78, discloses protective pants with front pocket containing foam material.

OBJECTS OF THE INVENTION

However, neither these nor any other known devices of the type as considered in the light of this invention are believed to afford the degree of appropriate protective and safety coupled with convenience in a Karate type uniform, and to provide these superior features while preserving the distinctive Karate uniform appearance is a principal object of the invention.

Further objects are to provide a new and advanced uniform as described which can be put on and taken off with speed, ease and certainty but which permits the wearer to perform martial arts disciplines unhampered and with comfort and security.

Still further objects are to provide a uniform as described which employs no metal or other hard fasteners, which holds the protective cup in the most body-protective manner, and which permits the user to urinate without removal or significant displacement of the garment.

Yet further objects are to provide a uniform as described which is easy and convenient to keep clean, which requires little or no foam rubber or similar thermally insulating material, which can be made substantially free of seams, which is economical to make and purchase, and which is durable in use and handsome in appearance.

BRIEF SUMMARY OF THE INVENTION

In brief summary given as cursive description only and not as limitation, the invention includes Karate-type pants with front opening closable by bottom-hinged open-top front envelope flap for retention and placement of a groin-protective cup, the sides of the flap affixably closable to the pants and the top of the flap extending above a belt portion of the pants and closable by friction of doubling over and behind the belt portion where it further positively affixes by attachment means.

BRIEF DESCRIPTION OF THE DRAWINGS

The above and other objects and advantages of the invention will become more evident upon examination of the following description, including the drawings, in which like reference numerals refer to like parts.

DETAILED DESCRIPTION OF THE DRAWINGS

Figure 1:
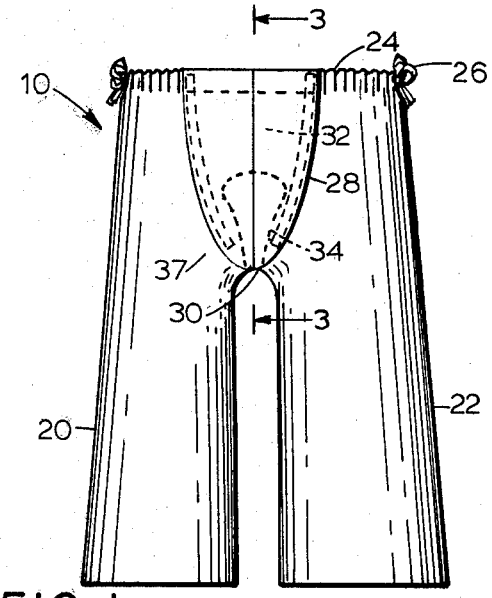
FIG. 1 is a front elevational view with front flap closed.

FIG. 1 shows the invention 10 as comprising a pair of Karate uniform pants with legs 20, 22, waist 24 including means for tightening 26 (shown as drawstrings but may be conventional continuous elastic belt within the waist, or both), front flap 28 with hinge connection 30 at mid-crotch, and inside in a pocket 32 in the flap, a conventional groin-protective cup 34.

Figure 2:
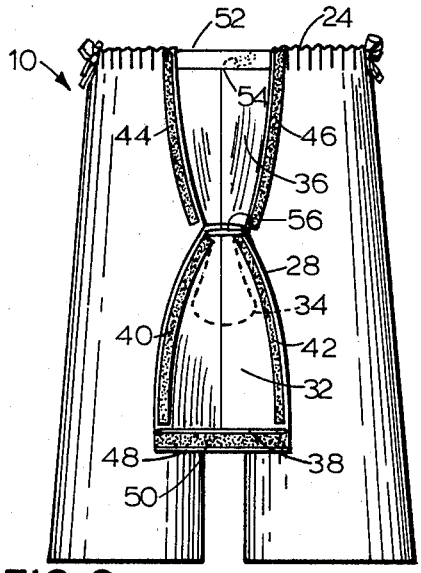
FIG. 2 is a front elevational view with front flap open.

FIG. 2 shows the invention with the front panel or front flap 28 dropped to an open position, hanging from the integral cloth-hinge connection, exposing triangular opening 36 defined by adjacent pants strucutre, for access to and from the interior.

The flap 28 is also generally triangular in shape and larger than the opening 36 so that the margins overlap. Holding means or pocket 32 for cup or protector 34 is closed at the crotch and sides and has an access opening 38 at the waist portion 24. Means for flap detachable attachment is as follows. Each flap lateral margin contains sewn or cemented therealong a respective flap strap 40, 42 of the hook-and-loop fabric-fastener or "Velcro" material and the margins of the opening 36 have, similiarly, respective strips 44, 46 of the coacting fabric-fastener material on them to mate with and detachably connect the flap by the flap strips.

The flap is sufficiently longer from the hinge connection to the waist portion or transverse portion 48 to permit a convenient mode of detachable attachment to the waist which is at the same time importantly a hold-fast attachment under the most violent exercise. If this fails, the protective cup can dislodge. The hold-fast attachment is as follows; the waist portion of the flap has across it at the end a strip 50 of fabric fastener. The upper margin of the opening 36 has a belt-like band 52 or supporting means across it, and the inside of this band has a strip of fabric-fastener across it.

To close the opening 36 the user either loosens the waistband pressure or draws in his stomach, then raises the flap 28 over the front of the band 52 and then tucks it down and to the rear over the band as a first means for securing, engaging the fabric fastener strip 50 on the waist end of the flap with a second means for securing in the form of a fabric fastener strip 54 along the length of the rear face of the belt-like band 52.

This both hooks the end of the flap 28 over the band 52 and secures it with the fabric fastener, both these first and second attachment modes being further secured by pressure of the waist of the uniform pants against the user's stomach. The sides of the flap are then pressed to unite the margins.

In spite of this multiple securance, reversing the process easily and quickly lowers the flap when desired.

A further feature visible in this Figure is strap 56 which spans and reinforces the flap in the crotch area about an inch (2.5 cm) from the hinge connection, preventing this hard plastic cup or other conventional material protector from being driven to the rear under the force of a kick or the like by an opponent of the wearer. Additionally the strap 56 can help hold the cup 34 in place when the flap 28 is lowered to the position shown as for relief, or cooling, or in the event medical attention is needed.

Figure 3:
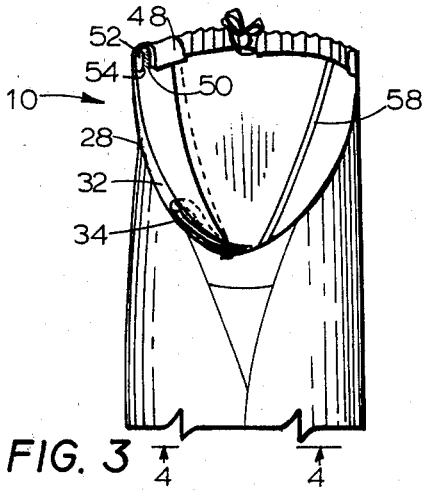
FIG. 3 is a partially sectional detail taken at 3—3, FIG. 1.

FIG. 3 shows positioning of the cup or protector 34 by the pocket 32 in the flap 28 well to the rear, substantially to the mid-point of the crotch, giving novel assurance that in Karate and similar martial arts performances the cup is less likely to be distributed by a kick deep into the crotch area. Biasing the whole crotch area of the pants to the rear to coact in holding the cup secure against such kicks is a pair of elastic straps 58 (one shown) which form in rear elevation a "V" shape extending integrally with the pants from an apex at the hinge connection to spaced apart termination on the waist in the rear.

Pocket 32 in the flap tends to hold tight-shut along the length of the pocket as result of the tucking attachment at the waist, even though the pocket is large above, the funnel shape makes introduction of the cup almost automatic.

Also shown here is the previously described attachment at the waist, the transverse end 48 of the flap being tucked over the band 52 so that the fabric fastener strip 50 on the flap and the fabric fastener strip 54 on the band 52 not only intergrip, but are forcibly pressed together by waistband and pressure on the user's waist which also grips because of the tucking of the waist end of the flap behind the band. Accidental forces pulling down on the flap must first pull the upper end of it upward over the band to release it.

Figure 4:
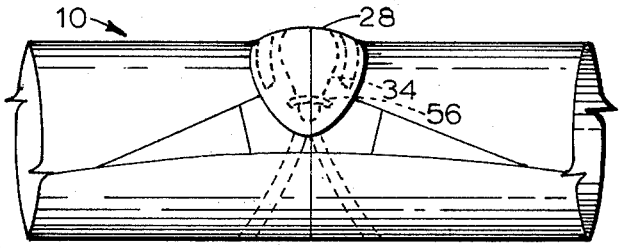
FIG. 4 is a detail view adapted from 4—4, FIG. 3, with the pants leg spread to the sides.

FIG. 4 shows details of the crotch area including flap 28, cup 34 and strap 56.

Figure 5:
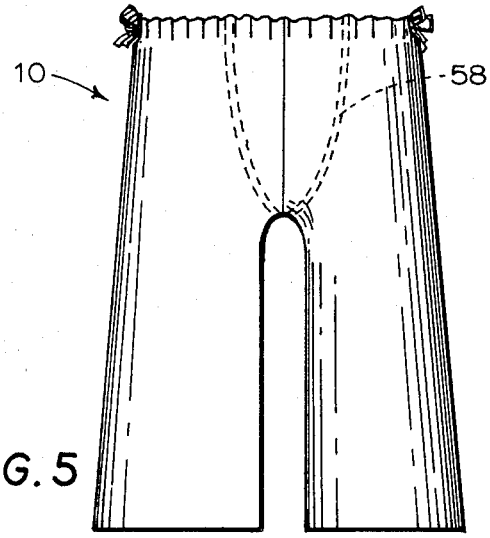
FIG. 5 is a rear elevational view.

FIG. 5 shows the rear aspect including the pair of elastic straps 58.

It will be appreciated from the above that the user/-wearer has in a traditional or professional looking uniform, advanced features of protection coupled with convenience such as being able to urinate without dropping the front flap simply by opening one side of it, it being as quickly closable.

Although seams are shown they need not be where indicated, and, if desired, the entire construction can be free of inner and outer seams or either. Also, the legs can be tapered as in Kung Fu pants, or in any other chosen style.

This invention is not to be construed as limited to the particular forms disclosed herein, since these are to be regarded as illustrative rather than restrictive. It is, therefore, to be understood that the invention may be practiced within the scope of the claims otherwise than as specifically described.

What is claimed and desired to be protected by United States Letters Patent is:

1. In a uniform for a wearer performing one of the martial arts such as Karate, which includes pants with an opening in front, a crotch having a mid-point, supporting means (52) for the pants and means for holding (32) detachably in the pants a cup (34) of rigid material in location for groin protection, the improvement comprising: said supporting means (52) having a length extending along the front of the pants, the pants having structure (37) defining the opening as beginning at the supporting means (52) and extending downwardly and rearwardly to said crotch mid-point, the means (32) for holding having connection at said crotch mid-point and proportion for closing said opening when in an upward position from said connection, first means (50, 48) for securing the means (32) for holding along the length of said means (52) for supporting, second means (54,52) for securing the means (32) for holding along the length of said means (52) for supporting, means (40,42,44,46) for attaching said means (32) for holding to the pants structure (37) defining the opening, said first means (50,48) for securing including said proportion having a length permitting the upper end (48) of the means (32) for holding to be passed upwardly over the front of the supporting means (52) and a portion thereof then returned downwardly to the rear of the supporting means (52), said downwardly returned portion (48) being in position for being gripped between said supporting means (52) and a wearer, said second means (54,52) for securing, securing said downwardly returned portion (48) to the supporting means (52) in said position for being gripped, said supporting means (52) being belt-like in shape and location, said first means (50,48) for securing and said second means (54,52) for securing including together a first fastening area (50) on a forward side of said downwardly returned portion (48) and a second fastening area (54) on a rearward side of the supporting means (52), said means (32) for holding being "V"-shaped in front view, with the apex of the "V" adjacent said crotch mid-point, said means (40,42,44,46) for attaching continuously attaching the sides of said "V" shape along the pants structure defining the opening, and the means (32) for holding including a pocket (32) with an opening (38) at the top for inserting and removing a said cup, the opening of the pocket being at a height causing the pocket to be held closed as result of said securing of the means for holding by said first means (50,48) for securing.

2. In a uniform for a wearer performing one of the martial arts such as Karate, which includes pants with an opening in front, a crotch having a mid-point, supporting means (52) for the pants and means for holding (32), detachably in the pants, cup (34) of rigid material in location for groin protection, the improvement comprising: said supporting means (52) having a length extending along the front of the pants, the pants having structure (37) defining the opening as beginning at the supporting means (52) and extending downwardly and rearwardly to said crotch mid-point, the means (32) for holding having connection at said crotch mid-point and proportion for closing said opening when in an upward position from said connection, first means (50,48) for securing the means (32) for holding along the length of said means (52) for supporting, second means (54,52) for securing the means (32) for holding along the length of said means (52) for supporting, means (40,42,44,46) for attaching said means (32) for holding to the pants structure (37) defining the opening, said first means (50,48) for securing including said proportion having a length permitting the upper end (48) of the means (32) for holding to be passed upwardly over the front of the supporting means (52) and a portion thereof then returned downwardly to the rear of the supporting means (52), said downwardly returned portion (48) being in position for being gripped between said supporting means (52) and a wearer, second means (54,52) for securing, securing said downwardly returned portion (48) to the supporting means (52) in said position for being gripped, said means (32) for holding being "V"-shaped in front view, with the apex of the "V" adjacent said crotch mid-point, and a strap (56) extending across approximately above said apex, inside said pants in position to limit downward travel of a said cup.

* * * * *